US009416787B2

(12) United States Patent
Tamminen et al.

(10) Patent No.: US 9,416,787 B2
(45) Date of Patent: Aug. 16, 2016

(54) METHOD AND ARRANGEMENT FOR ESTIMATING FLOW RATE OF PUMP

(75) Inventors: Jussi Tamminen, Lappeenranta (FI); Tero Ahonen, Lappeenranta (FI); Jero Ahola, Lappeenranta (FI)

(73) Assignee: ABB Technology Oy, Helsinki (FI)

( * ) Notice: Subject to any disclaimer, the term of this patent is extended or adjusted under 35 U.S.C. 154(b) by 1075 days.

(21) Appl. No.: 13/433,743

(22) Filed: Mar. 29, 2012

(65) Prior Publication Data

US 2012/0251292 A1 Oct. 4, 2012

(30) Foreign Application Priority Data

Mar. 31, 2011 (EP) ..... 11160574

(51) Int. Cl.
*F04D 27/00* (2006.01)
*F04D 15/00* (2006.01)

(52) U.S. Cl.
CPC ..... *F04D 15/0088* (2013.01); *F04D 27/001* (2013.01)

(58) Field of Classification Search
CPC ..... F04D 15/0066; F04D 15/0077; F04D 15/0088; F04D 27/001; F04D 27/00; F04D 27/004; F04D 29/669; F05B 2260/83; F05B 2260/84
USPC ..... 415/24, 26, 30; 702/46, 47
See application file for complete search history.

(56) References Cited

U.S. PATENT DOCUMENTS

| | | | | |
|---|---|---|---|---|
| 5,198,072 | A * | 3/1993 | Gabriel | 216/59 |
| 2005/0031443 | A1 * | 2/2005 | Ohlsson et al. | 415/30 |
| 2007/0185661 | A1 | 8/2007 | Venkatachari et al. | |
| 2010/0143157 | A1 | 6/2010 | Ahonen et al. | |

FOREIGN PATENT DOCUMENTS

| | | | |
|---|---|---|---|
| EP | 2 196 678 | A1 | 6/2010 |
| WO | WO 2005/085772 | A1 | 9/2005 |

OTHER PUBLICATIONS

European Search Report dated Sep. 8, 2011.

* cited by examiner

*Primary Examiner* — Dwayne J White
*Assistant Examiner* — Danielle M Christensen
(74) *Attorney, Agent, or Firm* — Taft Stettinius & Hollister LLP

(57) ABSTRACT

A method and arrangement for determining the flow rate (Q) produced by a pump, when the pump is controlled with a frequency converter, which produces estimates for rotational speed and torque of the pump, and the characteristic curves of the pump are known. The method includes determining the shape of a QH curve of the pump, dividing the QH curve into two or more regions depending on the shape of the QH curve, determining on which region of the QH curve the pump is operating, and determining the flow rate (Q) of the pump using the determined operating region of the characteristic curve.

6 Claims, 5 Drawing Sheets

METHOD AND ARRANGEMENT FOR ESTIMATING FLOW RATE OF PUMP

RELATED APPLICATION(S)

This application claims priority under 35 U.S.C. §119 to European Patent Application No. 11160574.7 filed in Europe on Mar. 31, 2011, the entire content of which is hereby incorporated by reference in its entirety.

FIELD

The present disclosure relates to a method and apparatus for estimating a flow rate produced by a pump or a blower, such as estimating a flow rate in a system controlled with a frequency converter.

BACKGROUND INFORMATION

Pumps can be used in industrial applications, and they can consume relatively large amounts of energy. About 15% of all electricity consumed by the industrial sector may be consumed in pumping applications. As the price of electricity rises and the desire to reduce energy consumption increases, monitoring the energy efficiency of pump systems becomes of greater interest. In order to monitor the energy efficiency or control the pump, the location of the operation point should be determined.

There are several methods to estimate the operating point of a pump with or without additional sensors. A known method is to measure directly the flow and head of the pump, which includes two or three separate sensors. In addition, there are available model-based methods, which are based on rotation speed and torque estimates of a frequency converter and pump characteristic curves.

The method that utilizes the measured head of the pump to estimate the pump operating point, later referred to as the QH curve-based method, may not be accurate at lower flow rates, where the head curve is in some cases flat or not monotonically decreasing but at high flow rates its accuracy can increase. Another model-based method for a frequency converter is a method that utilizes estimated power consumption and rotation speed for the estimation of the operation point of the pump. This method is later referred to as the QP curve-based method. This method is not applicable, when the power curve is non-monotonic, such as at high flow rates compared to the nominal flow rate of the pump. However, at lower flow rates the estimation can be more accurate. For example, the accuracy of both methods can be affected by the shape of the characteristic curves.

Both of the previously mentioned methods used in frequency converters apply the pump characteristic curves of the model of the pump. These curves are the flow rate to head curve (QH curve) and the flow rate to power curve (QP curve) of the pump. The curves are provided by the pump manufacturer, and can be available for all pumps. An example of the characteristic curves for a known centrifugal pump can be seen in FIG. 1. Specifically, FIG. 1 gives characteristic curves for a radial flow centrifugal pump with specific speed $n_q$=30. On the left plot there are the head to flow rate (QH) and net positive suction head to flow rate curves, on the right plot there is the power to flow (QP) curve.

The estimation of operation point of the pump can be difficult in the above mentioned cases when the characteristic curves are non-monotonic.

SUMMARY

A method of determining a flow rate (Q) produced by a pump controlled with a frequency converter is disclosed, which produces estimates for rotational speed and torque of the pump, wherein a characteristic curve of the pump is known, the method comprising: determining a shape of a characteristic curve of the pump; dividing the characteristic curve into two or more regions depending on the shape of the characteristic curve; determining an operating region of the characteristic curve on which the pump is operating; and determining the flow rate (Q) of the pump using the determined operating region of the characteristic curve, wherein the characteristic curve is at least one of a flow rate to head (QH) curve or a pressure to flow rate curve.

An arrangement for determining the flow rate (Q) produced by a pump when the pump is controlled with a frequency converter, which produces estimates for rotational speed and torque of the pump, and a characteristic curve of the pump is known, wherein the arrangement comprises: means for determining a shape of a characteristic curve of the pump; means for dividing the characteristic curve into two or more regions depending on a shape of the characteristic curve; means for determining on which region of the characteristic curve the pump is operating; and means for determining the flow rate (Q) of the pump using the determined operating region of the characteristic curve.

BRIEF DESCRIPTION OF THE DRAWINGS

In the following the disclosure will be described in greater detail by means of exemplary embodiments with reference to the attached drawings, in which.

DETAILED DESCRIPTION

Exemplary embodiments of the present disclosure provide a method and an arrangement for implementing the method wherein two existing methods (the QH curve-based and the QP curve-based) of pump operating point estimation are combined to determine the operating point location as accurately as possible.

Figure 3:
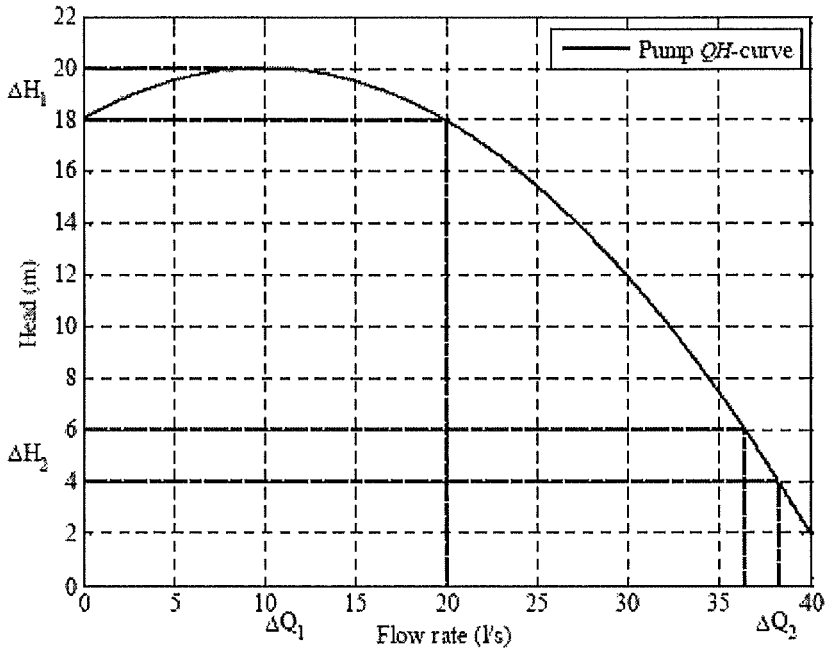
FIG. 3 illustrates the effect of the QH curve shape on the estimation accuracy.

The QH curve-based calculation method can have its best accuracy at the higher flow rates, when the head is monotonically decreasing and the flow rate to head curve has a steep decrease. At low flow rates, where there may be virtually no change in the produced head as a function of flow rate or the head curve is non-monotonic in that region, the QH curve-based method can be either inaccurate or unusable. This effect can be seen in FIG. 3. When operating in the low flow region ($\Delta H1$, $\Delta Q1$) there are two flow rates corresponding to one head value. Also small variation in head corresponds to a large variation in flow rate, when operating near the peak head values of the curve. This can also occur if the head curve is flat. When operating on a larger flow rate ($\Delta H2$, $\Delta Q2$), the QH curve is steep and small variations in the measured head do not have a significant effect on the estimated flow rate. Thus the QH curve-based method can be more accurate and reliable in that region.

Figure 4:
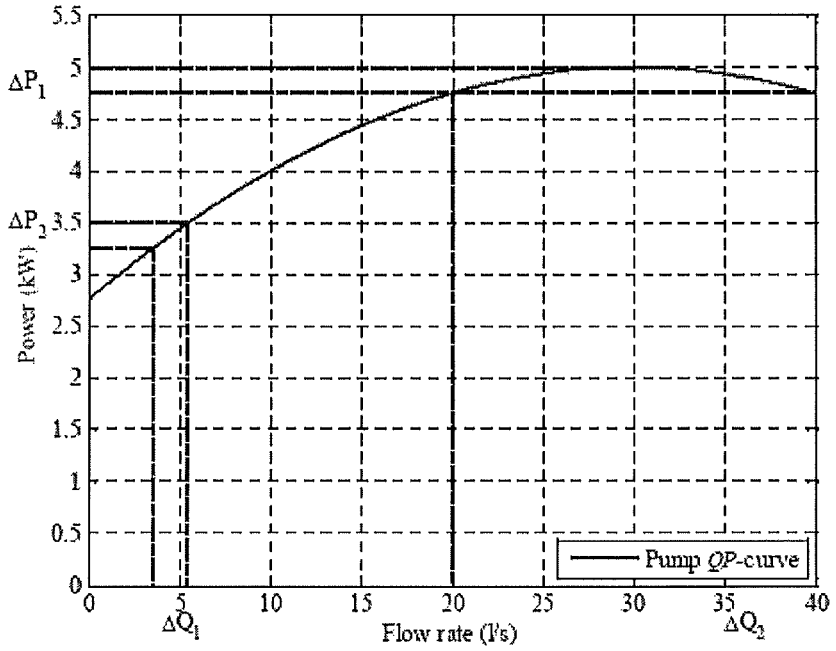
FIG. 4 illustrates the effect of the operating point and the pump characteristic curve on the accuracy of the QP curve-based operation point estimation method.

Correspondingly, the QP curve-based method can be either unusable or inaccurate at high flow rates, where the flow rate to power curve tends to be non-monotonic or flat, for example, in the case of mixed-flow centrifugal pumps. On the other hand, the QP curve-based method can be accurate at low flow rates, if the pump QP characteristic curve is steep in this region. An example of this can be seen in FIG. 4. The small variation of power at a small flow rate (ΔP1, ΔQ1) does not have a significant effect on the estimation of the flow rate. When the power curve is not continuously increasing on the high flow rates (ΔP2, ΔQ2), one power value corresponds to several flow rates, and thus the QP curve-based method may not be usable or accurate at the high flow rates.

Accuracy and reliability of the pump operating point estimation can be increased by combining these two methods and using them in their accurate regions. The method of an exemplary embodiment of the disclosure utilizes the QH curve-based estimation but when the QH curve-based estimation method is unusable, the QP curve-based method can be used as either an aid or as the only estimation method.

An advantage of the disclosure is that the estimation accuracy can be increased in situations when the characteristic curves are problematic for a single estimation method.

There are several types of pumps, which all have their own typical characteristic curve shapes. The curve shape is related to the specific speed of a pump and this dimensionless value can be calculated from $$n_q = n\frac{\sqrt{Q}}{H^{\frac{3}{4}}} \tag{1}$$

Figure 1:
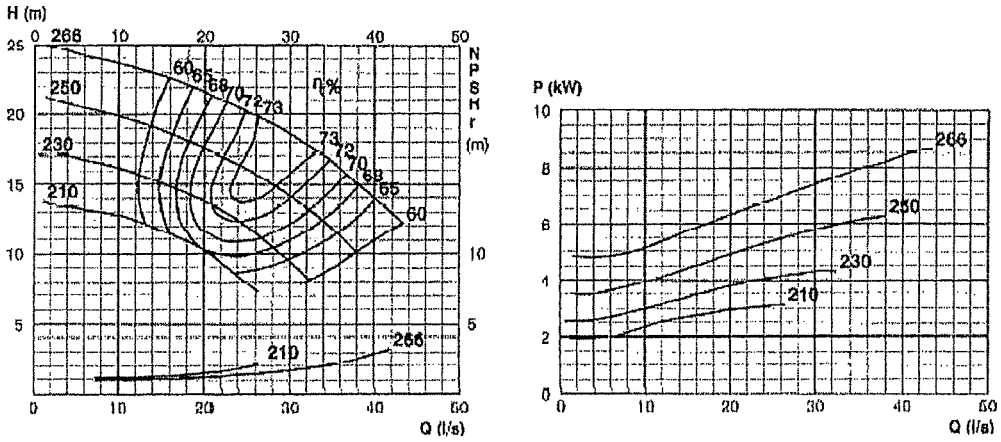
FIG 1 PRIOR ART
FIG. 1 shows an example of a known pump's characteristic curves.
Figure 2:
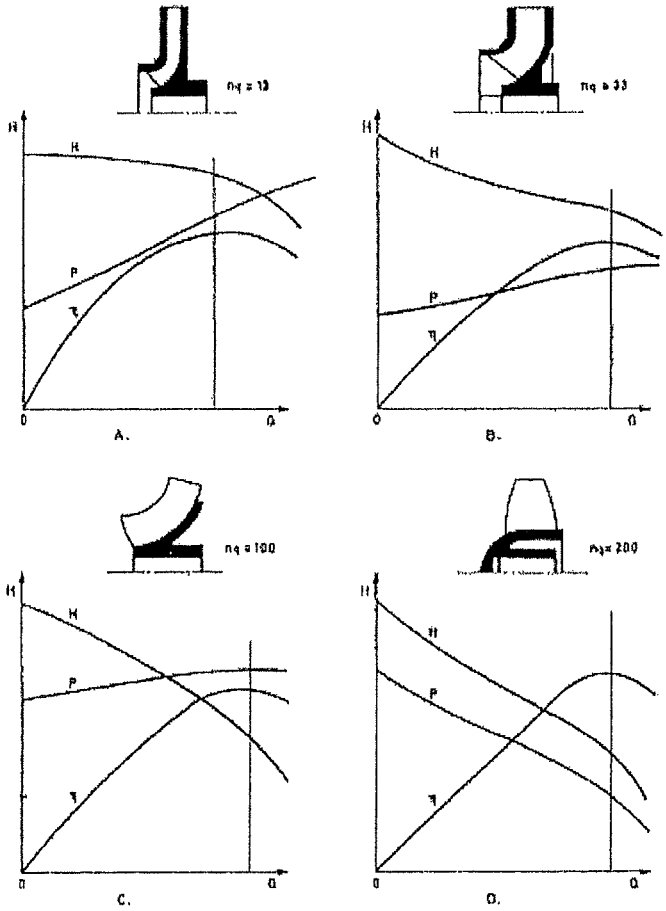
FIG. 2 shows effect of specific speed in the shape of the pump characteristic curves.

The method for calculating flow quantities according to an exemplary embodiment of the disclosure can be useful with pumps that have a small specific speed. As can be seen in FIG. 2, when the specific speed is small (e.g. nq=13), the head curve is flat but the power curve is monotonically increasing. When the specific speed increases, the head curves become more strongly monotonically decreasing with little or no flat parts. Thus the QH curve estimation is applicable to them in all operating points. There might also be pumps with an S-shaped QH curves, and the proposed method according to an exemplary embodiment of the disclosure can be applied also to them. This is possible, for example, if there is a monotonic QP curve available for the operating region, where the S-shape occurs in the QH curve. These types of curves can occur in mixed and axial flow devices.

The method for flow rate estimation can be, however, unusable, if in some range of flow rates the power estimate produces several estimates for the flow rate and in the same range the measured head corresponds to several heads.

The characteristics and general performance of a centrifugal pump can be visualized by characteristic curves for the head H, shaft power consumption P and efficiency η as a function of the flow rate Q at a constant rotational speed. As a frequency-converter-driven pump can be operated at various rotational speeds, the pump characteristic curves need to be converted into the instantaneous rotational speed. This can be performed by utilizing affinity laws:

$$Q = \frac{n}{n_0}Q_0, \tag{2}$$

$$H = \left(\frac{n}{n_0}\right)^2 H_0 \tag{3}$$

$$P = \left(\frac{n}{n_0}\right)^3 P_0 \tag{4}$$

where Q is the flow rate, H is the pump head, P is the pump shaft power consumption, n is the rotational speed, and the subscript 0 denotes the initial values given, for instance, in the published characteristic curves.

Figure 5:
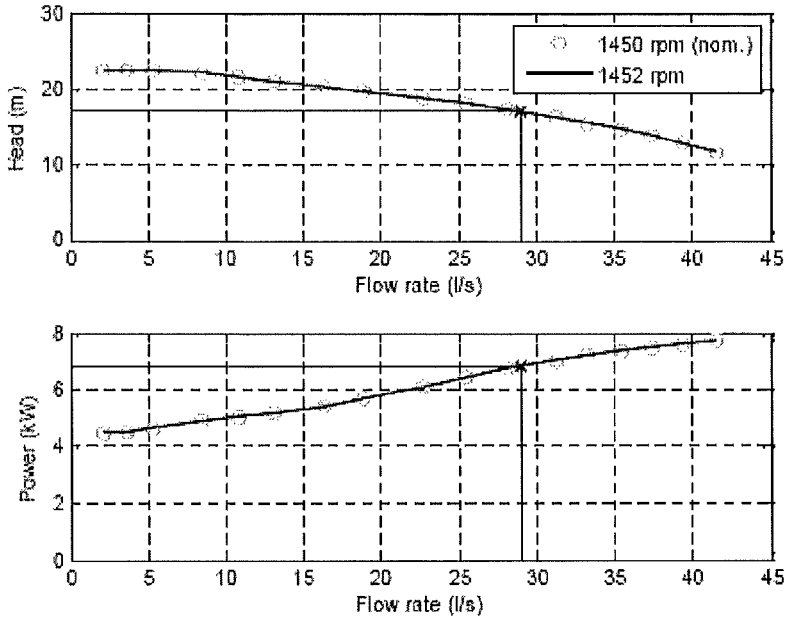
FIG. 5 illustrates QP curve-based estimation.

Pump characteristic curves allow sensorless estimation of the pump operating point location and efficiency by utilizing the rotational speed and shaft torque estimates (nest and Test, respectively) available from a frequency converter, as shown in FIG. 5. This model-based estimation method for the pump operating location is known and is not further discussed in this document.

The pump output can be estimated utilizing a pressure measurement and the pump characteristic curves. The estimation procedure is almost identical to that of FIG. 5, but the flow rate is estimated from the measured head and QH curve. The QH curve-based method is known and is already in use in frequency converters.

The estimation method of an exemplary embodiment according to the disclosure utilizes the QH curve-based calculation method whenever possible, because the actual head measurement from the process makes it inherently more accurate and reliable than the QP curve-based method. The QP curve-based estimation is utilized, when the head of the pump does not drop as a function of flow rate. The QP curve-based method is used as additional information, when the QH curve has two or more flow rates corresponding to a single head. At this area the QP curve-based estimation is used to determine, whether the operating point location is on the rising or the decreasing part of the QH curve.

According to an exemplary embodiment of the disclosure, the shape of the QH curve is first determined and then the QH curve is divided into two or more regions on the basis of its shape.

The QH curve can be divided into such regions that have similar properties. If the curve has a single peak, the curve is divided into two regions which are on both sides of the peak (see Case 1 below). If the QH curve has a flat region, the curve is divided at the point where the curve begins steepening. The steepening of the curve can be determined on the basis of the derivate of the curve (Case 2).

In some cases the QH curve is divided into three regions. As illustrated in connection with Case 3 below, the QH curve may be S-shaped. In such a case each of the monotonically decreasing or increasing parts of the curve form a region.

As mentioned above, a derivate of the curve can be calculated. When the derivative is zero the region of the curve changes. In other words, the zero derivative points of a QH curve are the limits in which the region changes. Because the QH curves are in the readable memory, the curve can be divided easily into regions by seeking the highest and lowest values of the curve or the values of flow in which the rise of the head value turns into fall of head value or the fall of the head value changes into rise of the head value.

The method according to an exemplary embodiment of the disclosure further includes determining in which region of the QH curve the pump is operating and determining the flow rate of the pump using the determined operating region of the characteristic curve. This determination is carried out in two different ways depending on the shape of the QH curve. If the QH curve has a region in which the curve does not drop or drops only little, the region can be determined on the basis of the measured head (Case 2). If the measured head is on the substantially flat region, QH curve cannot give reliable results, and the value of flow is determined using the QP curve-based method. If, on the other hand, the measured head is outside the substantially flat region, the flow is determined with the QH curve-based calculation using the measured head.

If the QH curve has two or more regions in which the head drops and increases as a function of flow (Cases 1 and 3), the flow rate is determined in the following manner. First QP curve-based method is used to determine in which region the pump is operating. In the QP curve-based method, first the power consumed by the pump is determined using the estimates obtained from the frequency converter. The frequency converter produces estimates of the rotational speed of the pump and torque of the pump. This information is used in calculating the power P used by the pump. When the power is estimated, the power is used for estimating the flow rate using the QP curve. The estimated flow rate is then used for determining in which region of the QH curve the pump operates. The region in question is used then in QH curve-based calculation for estimating the flow rate based on the measured head. Thus the flow rate estimated using the QP curve-based method is not used as representing the operation point of the pump, but only to determine in which region of the QH curve the pump operates.

The flow rate and efficiency of the pump are estimated, but the measured head is never substituted by the estimated head. Also, the power used is not estimated from the characteristic curves in any case. Rather more accurate estimation given by the frequency converter is used.

In the following, a few examples are given for illustrating the operation of the method together with FIGS. 6, 7, 8 and 9.

Case 1: Non-Monotonic Head-to-Flow Rate Curve (FIG. 6)

When the pump has a non-monotonic head-to-flow rate curve, the method utilizes the QP curve-based estimation to determine (61) an estimate for the flow rate $Q_{QP}$. The flow rate is further used to determine (62), if the operating point is on the left or right side of the peak H value. After the decision, the measured head is used to determine the flow rate (63). In the example of Case 1, the estimated flow $Q_{QP}$ is on the left side of the peak head and the left side of the QH curve is used in determining the flow rate.

Figure 6:
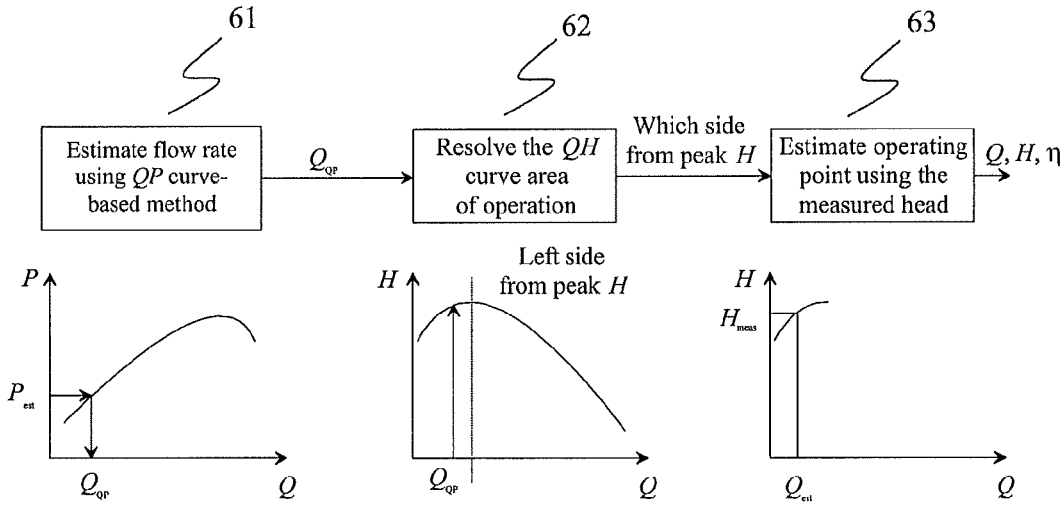
FIGS. 6, 7, 8 and 9 illustrate the operation of the method and arrangement according to exemplary embodiments of the disclosure.
Figure 7:
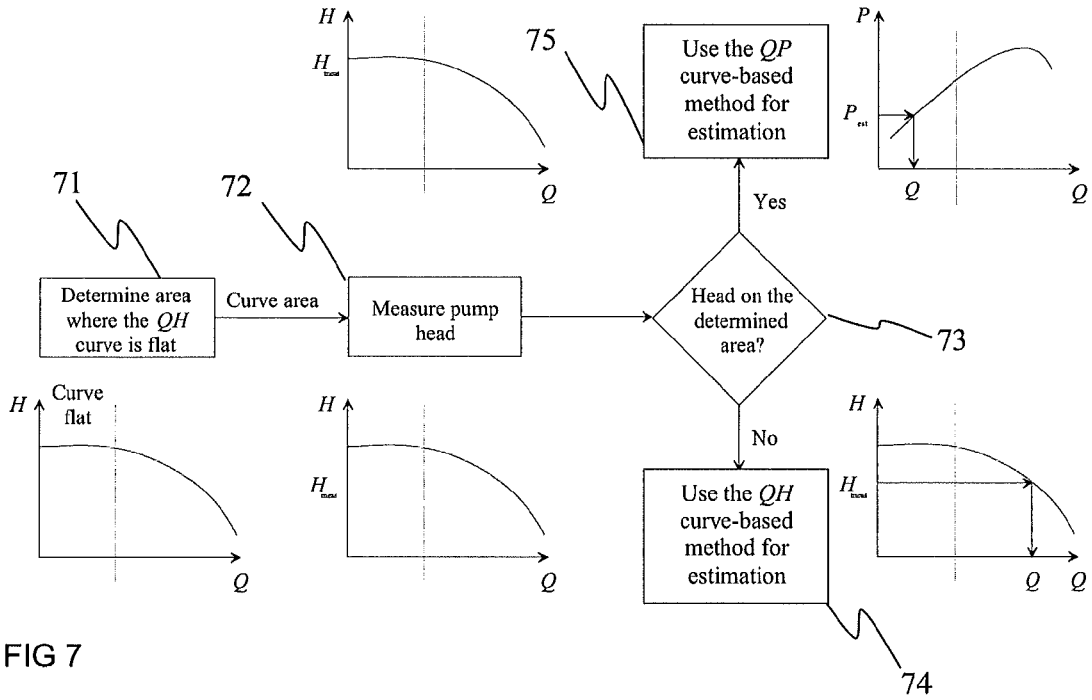
Figure 8:
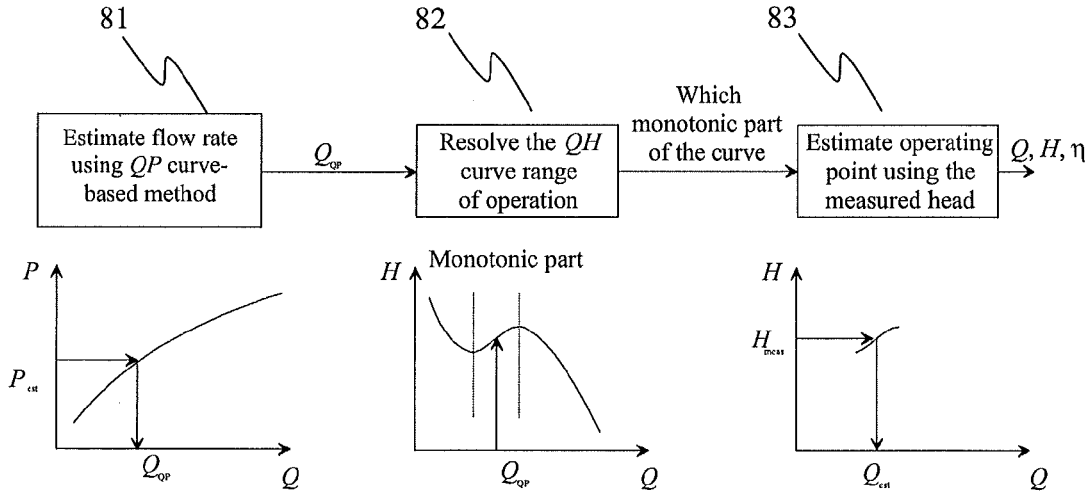

The flow charts of FIGS. 6, 7 and 8 contain also illustrations of QP and QH curves for better understanding of the flow chart and the disclosure.

Case 2: No-Drop or Little Drop in QH Curves (FIG. 7)

If there is no drop or little drop in the QH curves of the pump, an area should be determined (71), where the QH curve-based estimation method is not used. This area can be limited to a certain value of the QH curve derivate, for example 0.1 m·s/l, which indicates that a 0.1 meter change in the measured head corresponds to a 1 l/s change in the flow rate. When the unusable head area is determined, the head is measured (72) to check whether or not the pump is operating at that area (73).

If the pump is outside the unusable head area (74), the QH curve-based estimation method is used; else the QP curve-based method is utilized (75). The flow chart and curve shapes are given in FIG. 7.

Case 3: S-Shaped QH Curve (FIG. 8)

There are some cases, where the QH curve is S shaped, this can be the case in axial flow devices. The operation of the method is basically the same as in connection with the above Case 1. In this case the QH curve is divided into regions in which the curve either rises or falls. In the example of FIG. 8, the monotonically increasing part of the QH curve is determined (82) utilising the QP curve-based estimation method (81). From this monotonic part of the QH curve the flow rate is estimated (83) utilising the measured head.

Case 4: QP and QH Curves S-Shaped at the Same Flow Rate Region

Figure 9:
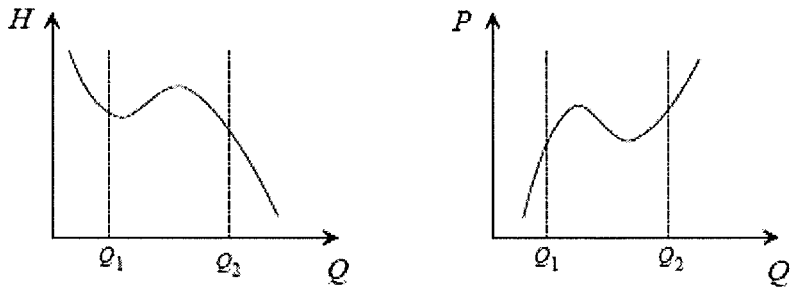

There may be cases in which the QH and QP curves are S-shaped in the same flow rate region as presented in FIG. 9 with the flow rates between Q1 and Q2. In these cases the method offers no additional benefit to the estimation of the pump flow rate.

While using both of the estimation methods, the QH curve-based method gives an acceptable flow rate range in which the QP curve-based estimation of the flow rate should be. If the QP curve-based estimation is outside the range of acceptable flow rates, then the method according to an exemplary embodiment of the disclosure cannot be used, as there is some inaccuracy in the QP-model that makes the estimation flawed. The acceptable range for the flow rate can be determined, for example by estimating the flow rate with heads equal to Hmeas+0.5 m and Hmeas−0.5 m, where Hmeas is the measured head.

There may be different reasons for the difference in the estimation methods. The QP curve provided by the manufacturer may be inaccurate. In this case the QP curve should be measured to enhance the QP curve accuracy.

Also, another likely reason for the difference in the estimates is the progressive wear in the pump. This can be the case, when the difference has started to appear after the pump has been operated for some period of time.

Fans are analogous to pumps and for this reason the method can also be applicable to fans. The manufacturer provides a total pressure to flow rate curve and a power to flow rate curve. In fans the total pressure is analogous to the head in pumps. Thus the use of the proposed method according to an exemplary embodiment of the disclosure can also be applicable to fans with little or no changes. The affinity laws are applicable to fans as given in equations (2)-(4) as the rotational speed changes.

Because static pressure is easier to measure than total pressure and it can be used more often, the total pressure curves provided by the manufacturer can be converted to static pressure to flow rate curves, if needed. This can be done easily by removing the dynamic part of the total pressure.

$$p_{static} = p_{total} - \frac{1}{2}\rho\left(\frac{Q_V}{A}\right)^2 \tag{5}$$

where ρ. is the fluid density, $Q_v$ is the volumetric flow rate, A is the cross-sectional area in which the flow is measured. The cross-sectional area can be the fan inlet area, but can be specified as something else in the data sheet of the fan.

The exemplary embodiments of the present disclosure can be implemented by at least one processor (e.g., general purpose or application specific) of a computer processing device which is configured to execute a computer program tangibly recorded on a non-transitory computer-readable recording medium, such as a hard disk drive, flash memory, optical memory or any other type of non-volatile memory. Upon executing the program, the at least one processor is configured to perform the operative functions of the above-described exemplary embodiments. Where measurements are performed, these are performed by suitable sensors and the measurements are communicated to the processor by any suitable method, for example.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A method of determining a flow rate (Q) produced by a pump controlled with a frequency converter, which produces estimates for rotational speed and torque of the pump, wherein a QH curve and QP curve of the pump are known, the method performed by a processor configured to:

determine a shape of the QH curve of the pump;

divide the QH curve into two or more regions depending on the shape of the OH curve;

determine an operating region of the QH curve on which the pump is operating; and determine the flow rate (Q) of the pump using the determined operating region of the QH curve, wherein determining the operating region comprises:

measuring a head produced by the pump;

estimating the flow rate using a QP curve-based method;

determining the operating region from the estimated flow rate wherein determining the flow rate uses the determined operating region of the QH curve and the measured head produced by the pump; and controlling the pump based on the determined operating region.

2. The method according to claim 1, wherein the processor is configured to determine the shape of the QH curve by determining a derivate of the curve; and use the determined derivate to divide the QH curve into differing regions.

3. The method according to claim 2, wherein the processor is configured to determine the shape of the QH curve in the frequency converter from the characteristic curve transformed to a rotational speed of the pump.

4. The method according to claim 1, wherein the processor is configured to determine the shape of the QH curve in the frequency converter from the OH curve transformed to a rotational speed of the pump.

5. An arrangement for determining a flow rate (Q) produced by a pump when the pump is controlled with a frequency converter, which produces estimates for rotational speed and torque of the pump, and a QH curve and a QP curve of the pump are known, wherein the arrangement comprises:

means for determining a shape of the QH curve of the pump;

means for dividing the QH curve into two or more regions depending on a shape of the QH curve;

means for determining on which region of the QH curve the pump is operating; and means for determining the flow rate (Q) of the pump using the determined operating region of the QH curve, wherein means for determining the operating region comprises:

means for measuring a head produced by the pump;

means for estimating the flow rate using a QP curve-based method; and means for determining the operating region from the estimated flow rate;

wherein the means for determining the flow rate determines the flow rate using the determined operating region of the QH curve and the measured head produced by the pump; and controlling the pump based on the determined operating region.

6. A method of determining a flow rate (Q) produced by a blower controlled with a frequency converter, which produces estimates for rotational speed and torque of the blower, wherein a pressure to flow rate curve and QP curve of the blower are known, the method performed by a processor configured to:

determine a shape of the pressure to flow rate curve of the blower;

divide the pressure to flow rate curve into two or more regions depending on the shape of the pressure to flow rate curve;

determine an operating region of the pressure to flow rate curve on which the blower is operating; and determine the flow rate (Q) of the blower using the determined operating region of the pressure to flow rate curve, wherein determining the operating region comprises:

measuring a total pressure produced by the blower;

estimating the flow rate using a QP curve-based method;

determining the operating region from the estimated flow rate wherein determining the flow rate uses the determined operating region of the pressure to flow rate curve and the measured total pressure produced by the blower; and controlling the blower based on the determined operating region.

* * * * *